United States Patent [19]

Barten

[11] 4,193,015

[45] Mar. 11, 1980

[54] COLOR TELEVISION DISPLAY TUBE

[75] Inventor: Piet G. J. Barten, Eindhoven, Netherlands

[73] Assignee: U.S. Philips Corporation, New York, N.Y.

[21] Appl. No.: 935,030

[22] Filed: Aug. 18, 1978

[30] Foreign Application Priority Data

Sep. 1, 1977 [NL] Netherlands ..... 7709617

[51] Int. Cl.[2] ..... H01J 29/07; H01J 29/32; H01J 31/20

[52] U.S. Cl. ..... 313/408; 313/470

[58] Field of Search ..... 313/461, 408, 403, 470

[56] References Cited

U.S. PATENT DOCUMENTS

| | | | |
|---|---|---|---|
| 2,947,898 | 8/1960 | Heil | 313/408 |
| 3,866,082 | 2/1975 | Barten | 313/470 |
| 3,979,630 | 9/1976 | Van Ormer | 313/408 |
| 3,988,777 | 10/1976 | Hosokoshi et al. | 313/408 X |
| 4,070,596 | 1/1978 | Tsuneta et al. | 313/408 |
| 4,100,452 | 7/1978 | Kaplan | 313/408 |

*Primary Examiner*—Palmer C. Demeo
*Attorney, Agent, or Firm*—Algy Tamoshunas

[57] ABSTRACT

Color television display tube of the shadow mask type with phosphor lines. In connection with the unequal center distances between the central electron spot and the two outermost electron spots of a triplet as a result of the properties of the deflection coils, the width of the phosphor lines is chosen to be so that the electron spots in the case of mislanding simultaneously cross the edge of the phosphor lines. As a result of this the "white-remains-white" effect is obtained. The intermediate spaces between the phosphor lines of a triplet are preferably equal, which facilitates the inspection of the screens during the manufacture.

2 Claims, 4 Drawing Figures

COLOR TELEVISION DISPLAY TUBE

The invention relates to a colour television display tube comprising means to generate three electron beams, a display screen having a large number of triplets of parallel phosphor lines stripes luminescing in three different colours, and a shadow mask having apertures which assign each electron beam to phosphor lines of one colour.

Such a colour television display tube is disclosed in Netherlands Patent Application 72 14 003 corresponding to U.S. Pat. No. 3,866,082 laid open to public inspection. As described in this patent application, the visible effect of landing errors of the electron beams on the phosphor lines can be reduced by choosing the central colour of a triplet to be red and to make the red phosphor lines wider than the green and blue phosphor lines. However, it has been found that with such an arrangement red spots are formed in the picture in the case of serious mislanding.

The aforementioned patent application does not take into account the fact that the center-to-center distance between the central electron spot of a triplet and the two outermost electron spots are unequal over large parts of the display screen as a result of the properties of the deflection coil system. In practice this is taken into account by a suitable choice of the center-to-center distances between the central phosphor lines of a triplet and the two outermost phosphor lines. However, this has two disadvantages. First, this makes it substantially impossible to determine, during the manufacture of the display screens, whether the locations of the lines are correct so that faultily illuminated screens are discovered only during a stage at which it is much too late to correct them. Secondly, with increasing mislanding, all three electron beams do not impinge simultaneously on phosphor lines of the adjacent wrong colour.

It is the object of the invention to provide a pattern of phosphor lines such that inspection is possible at an early stage of the screen manufacture and, in addition, to provide a screen in which a reserve white does not change colour when the landing reserve is exceeded, in other words a "white-remains-white" effect is obtained.

According to the invention, the colour television display tube of the kind described above comprises a display screen in which the center-to-center distances between the phosphor lines or stripes of a triplet are equal, the widths of the two outermost phosphor lines of a triplet are equal, and the difference in width of the central phosphor line and an outermost phosphor line of a triplet is equal to the difference of the center-to-center distances between the central electron spot and the two outermost electron spots of the electron beams causing the triplet to luminesce.

The equal center-to-center distances between the phosphor lines of a triplet, simplifies the inspection of the display screens. It will, furthermore, be apparent from the explanation given below, that a "white-remains-white" effect is achieved with the indicated difference in width between the central phosphor line and the outermost phosphor lines.

In addition the intermediate spaces between the phosphor lines of a triplet and between a phosphor line of that triplet and a phosphor of an adjacent triplet are preferably equal so that the above advantages are obtained to an even greater extent.

The invention will be described in greater detail with reference to the accompanying drawing, in which.

Figure 3:
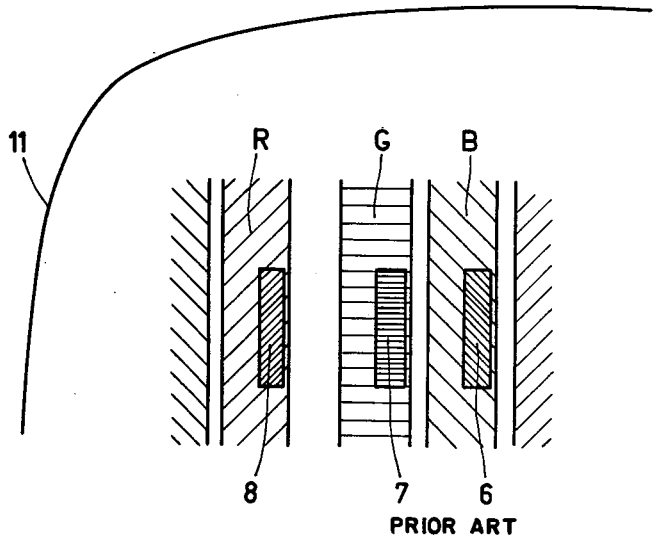

FIG. 3 explains the pattern of phosphor lines in a known tube and

Figure 4:
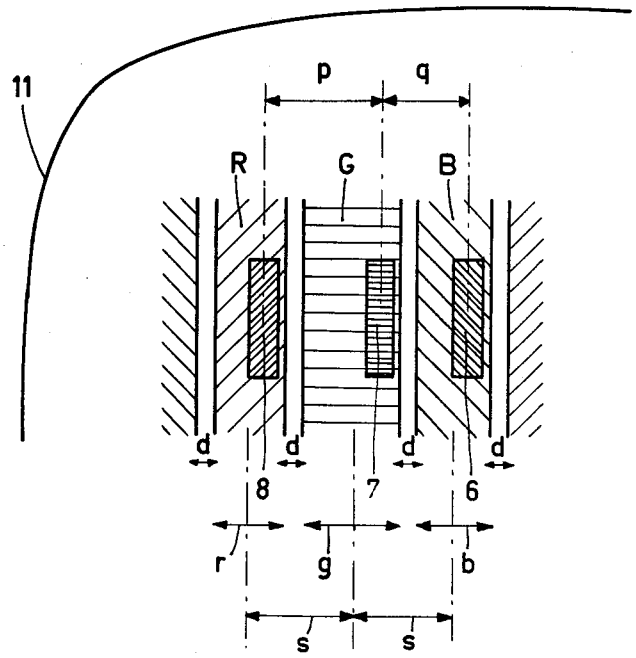

FIG. 4 explains the pattern of phosphor lines in a tube according to the invention.

Figure 1:
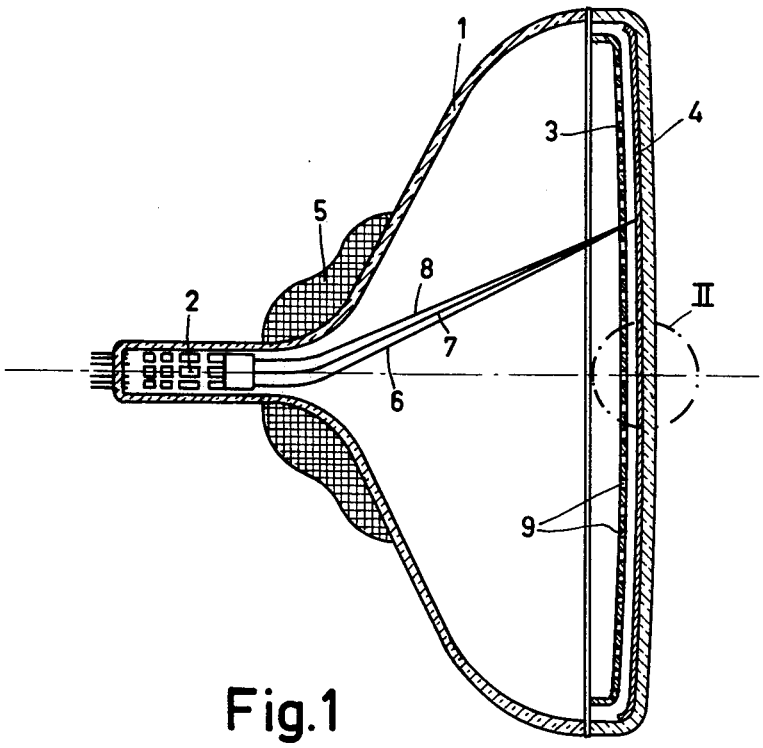
FIG. 1 shows a colour television display tube according to the invention.

FIG. 1 shows a colour television display tube having an evacuated envelope 1 comprising an electron gun 2, a colour selection mask 3, a display screen 4 and provided with deflection coils 5. The electron gun 2 generates three electron beams 6, 7 and 8 which converge towards the display screen 4. In the non-deflected condition, the axes of the electron beams 6, 7 and 8 are situated in the plane of the drawing. The deflection coils 5 deflect the electron beams 6, 7 and 8 in a manner such that the display screen 4 is scanned. The scanning occurs in known manner according to a line-scanning pattern, the lines being are parallel to the plane of the drawing.

Figure 2:
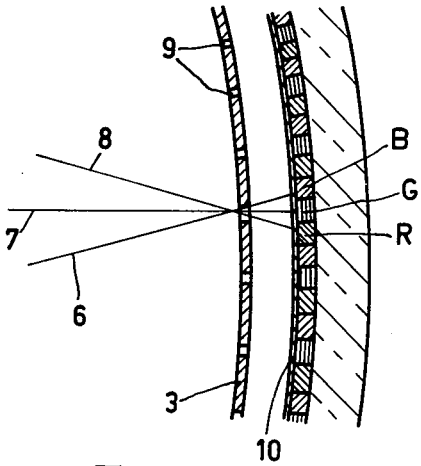
FIG. 2 shows a part of FIG. 1 on an enlarged scale.

FIG. 2 explains the colour selection effected by the colour selection mask 3 and shows the circled portion of FIG. 1 at an enlarged scale. The colour selection mask 3 has a number of apertures 9 which partly pass the electron beams 6, 7 and 8. As a result of the angle which the electron beams enclose with each other, the electron beam 6 impinges only upon phosphor lines B on the display screen 4 which luminesce in blue. The beam 7 in the same manner impinges only upon green (G) phosphor lines and the beam 8 only on red (R) phosphor lines. The display screen 4 furthermore comprises in known manner a very thin, electron-permeable aluminium layer 10.

The three phosphor lines associated with any one aperture of the colour selection mask 3 constitute a triplet. The phosphor lines are substantially parallel and extend perpendicularly to the lines of the aforementioned line-scanning pattern. The apertures 9 are slot-shaped and, of course, extend parallel to the phosphor lines. In this connection, a slot-shaped aperture is also to be understood, to include a row of apertures parallel to phosphor lines which form a a slot having reinforcement bridges. In connection with the method of manufacturing the tube, the reinforcement bridges can be recognizable in the phosphor lines.

The tube is made by providing a photo-sensitive layer on a window portion of the tube and exposing the layer through the shadow mask by means of a light source whose position is closely related to the deflection point of the electron beams as they are scanned by the deflection coils 5. The phosphor lines of each color are exposed from a different location using a correction lens in a known manner. The exposure and development of the photosensitive layer, furthermore, occurs in a known manner according to a photochemical or an electrophotographical method. By means of the correction lens it is possible to accurately determine the place where a phosphor line is provided. The width of the phosphor lines can be varied in a known manner by controlling the exposure time and by use of filters.

FIG. 3 explains the pattern of phosphor lines and the landing of the electron beams in a known tube. The diagrammatically shown screen portion is situated in the left-hand top corner of the display screen with the symbolically denoted screen edge 11. The phosphor lines of one triplet are denoted by R, G and B and the electron spots on the phosphor strips are denoted by 8, 7 and 6. As a result of the properties of the deflection coils, the distances between the centers of the electron spots 6 and 7 and 7 and 8, respectively, are unequal over large portions of display screen. In the known tubes, this is taken into account by corresponding variations of the distances between the centers of the phosphor stripes B and G and G and R, respectively. When the mislanding is not too large the electron spots 6, 7 and 8 reach the edge of the phosphor lines B, G and R simultaneously. This situation is shown in FIG. 3.

It is to be noted that the most important cause of mislanding is a bulging of the shadow mask as a result of thermal effects. The result of this is that the three electron spots 6, 7 and 8 are moved collectively in the direction of the center of the display screen with respect to the phosphor lines B, G and R. Thus, in FIG. 3, this movement is oblique towards the lower right. As can also be seen from this Figure, in the case of serious mislanding, the electron spots 6 and 7 will land on an adjacent phosphor line sooner than the electron spot 8 so that a "white-remains-white" effect is not obtained. It will, furthermore, be obvious that as a result of the unequal spacing between the phosphor lines, their correct mutual position is difficult to control with reference to the display screen alone.

FIG. 4 corresponds to FIG. 3 and explains the pattern of phosphor lines and the landing of the electron beams in a tube according to the invention. The distances between the centers of the electron spots 6 and 7 is denoted by q and that between the electron spots 7 and 8 is denoted by p. The intermediate spaces between the phosphor lines are equal and are denoted by d. The width of the phosphor lines is denoted by b, g and r (where b=r) and the distances between the centers of the phosphor lines of a triplet are equal and are denoted by s. In FIG. 4 the mislanding is also such that the electron spots have just reached the edge of the phosphor lines.

From FIG. 4 it is apparent that $p=g+d$ and $q=b+d$, from which it follows that $p-q=g-b$. This means that the difference in width of the central phosphor line and the outermost phosphor lines of a triplet is equal to the difference of the center-to-center distances between the central electron spot and the two outermost electron spots. It will furthermore be obvious from FIG. 4 that in the case of larger mislanding (towards the right in the Figure) the electron spots 6, 7 and 8 will land simultaneously on an adjacent phosphor line. As a result, when a white colour is displayed, which means that the electron beams have substantially the same current strength, the ratio between the currents which impinge upon the phosphor lines is not varied. With this arrangement, thus a white does not change colour in the case of a mislanding. In practice it has been found that this so-called "white-remains-white" effect makes mislanding far less noticeable to the viewer of the displayed picture.

In a practical example of a tube according to the invention having a display screen diagonal of 66 cm, the properties of the system of deflection coils are such that at approximately $\frac{2}{3}$ of the distance from the center of the display screen to the left-hand top corner p=273 microns and q=263 microns. According to the invention, g−b must be equal to 10 microns. In the tube in question, g=255 microns, b=r=245 microns, d=18 microns and s=268 microns. The center-to-center distance between two triplets is 799 microns. The values of p and q for a given combination of tube-deflection coils are known for each place on the display screen. The desired pattern of phosphor lines can, therefore, be computed, from which the design of the correction lenses to be used during the exposure is derived in the usual manner.

It is to be noted that the properties of the usual system of deflection coils are such that the central electron spot of a triplet is moved with respect to the center between the two outermost electron spots in the direction of the center of the display screen. In principle it is also possible for this movement to take place in the reverse direction, that is to say that q is larger than p in FIG. 4. According to the invention the central phosphor line then becomes narrower (instead of wider as in the above-mentioned example) than the two outermost phosphor lines according to $q-p=b-g$.

I claim:

1. A colour television display tube comprising, in an evacuated envelope, a display screen having a plurality of triplets of parallel phosphor stripes spaced from each other and each luminescing in one of three different colors when struck by electrons, means for generating three electron beams directed onto said screen and a shadow mask having a plurality of apertures for assigning each beam to phosphor stripes of one color so that said beams impinge on said screen and form three spaced electron spots each on a respective one of said phosphor stripes, wherein the distances between the centers of adjacent phosphor stripes of a triplet are equal, the widths of the two outermost phosphor stripes of a triplet are equal and the difference between the widths of the central phosphor stripe and an outermost phosphor stripe of a triplet is equal to the difference of the center-to-center distances between the central electron spot and the two outermost electron spots which cause the triplet to luminesce.

2. The tube according to claim 1, wherein the distance between adjacent phosphor stripes of a triplet is equal to the distance between an outermost phosphhor stripe of said triplet and an adjacent phosphor stripe of an adjacent triplet.

* * * * *